United States Patent [19]

Hirose et al.

[11] Patent Number: 5,074,131

[45] Date of Patent: Dec. 24, 1991

[54] DRYER AND WASHING/DRYING MACHINE

[75] Inventors: Etsurou Hirose; Yoshinori Fujimori; Kengi Natsuno; Hideya Koshiyama, all of Hitachi; Tamotsu Shikamori, Ibaraki, all of Japan

[73] Assignee: Hitachi, Ltd., Tokyo, Japan

[21] Appl. No.: 497,623

[22] Filed: Mar. 23, 1990

[30] Foreign Application Priority Data

Mar. 27, 1989 [JP] Japan ..... 1-71724

[51] Int. Cl.[5] ..... D06F 23/00; D06F 25/00; D06F 37/20

[52] U.S. Cl. ..... 68/19.2; 34/133 R; 68/20; 68/23.1; 68/25

[58] Field of Search ..... 68/19.2, 20, 23.1, 23.3, 68/25; 34/133

[56] References Cited

U.S. PATENT DOCUMENTS 2,782,622 2/1957 Candor ..... 68/25

4,742,698 5/1988 Torita ..... 68/23.3 X

FOREIGN PATENT DOCUMENTS 0252323 1/1988 European Pat. Off. .

52797 4/1980 Japan .

140280 1/1982 Japan .

8912711 12/1989 World Int. Prop. O. .

751087 6/1956 United Kingdom .

*Primary Examiner*—Philip R. Coe

*Attorney, Agent, or Firm*—Antonelli, Terry, Stout & Kraus

[57] ABSTRACT

A washing/drying machine capable of effecting washing and drying as a continuous process. Washing, rinsing, dehydrating and drying are performed while a rotary basket is retained in a vertical position. After the dehydration the rotary basket is inclined and is rotated on its axis, so that an opening end of the rotary basket is located slightly higher than the horizontal. In this state, hot air for drying is blown into the rotary basket from the opening side.

46 Claims, 10 Drawing Sheets

DRYER AND WASHING/DRYING MACHINE

BACKGROUND OF THE INVENTION

This invention relates to a dryer for drying washed clothes and to a washing/drying machine capable of successively performing washing and drying.

Japanese Utility Model Unexamined Publication No. 57-140280 discloses a fully automatic washing machine in which washing/dehydrating basket stands upright to perform washing and centrifugal dehydration and thereafter is inclined so as to perform drying operation.

Japanese Utility Model Unexamined Publication No. 61-21476 discloses a drum type washing/drying machine in which a rotary drum is held in an inclined position. Hot air is blown into this drum through small vent holes formed in the peripheral wall of the drum and is exhausted through a front opening. The exhaust air is again heated and blown into the rotary drum through the small vent holes to provide a circulating flow of heated air.

Japanese Patent Unexamined Publication No. 55-52797 discloses a drum type clothing dryer in which a rotary drum is held in an inclined position. Hot air is blown into the drum through small vent holes formed in a bottom of the rotary drum and is exhausted through an exhaust opening formed in a lid member closing front opening of the rotary drum.

During the drying operation of the machine disclosed in Japanese Utility Model Unexamined Publication No. 57-140280, the wash to be dried is revolved in the washing/dehydrating basket. With the rotation of the washing/dehydrating basket, the wash to be dried is moved upwardly by lifters and falls downward by the gravity. However, since the washing/dehydrating basket lies horizontally, the revolving motion of the wash is limited to a motion on one plane. In other words, the wash to be dried is not moved in the direction of the depth of the washing/dehydrating basket. It is therefore difficult to uniformly dry the wash.

The machine disclosed in Japanese Utility Model Unexamined Publication No. 61-21476 moves the wash to be dried in the direction of the depth of the rotary drum, because the rotary drum is disposed in an inclined position. However, the drying efficiency of this machine is low since the drying operation is carried out by blowing hot air into the rotary drum through the small vent holes formed in the peripheral wall thereof and causing the air to flow to the front opening of the rotary drum.

The machine disclosed in Japanese Patent Unexamined Publication No. 55-52797 also moves the wash to be dried in the direction of the depth of the rotary drum, because the rotary drum is disposed in an inclined position. In this machine, however, hot air enters the rotary drum through the small vent holes formed in the bottom thereof and flows to the front opening of the rotary drum, and the drying efficiency is therefore low.

SUMMARY OF THE INVENTION

It is an object of the present invention to provide a machine in which the wash to be dried moves in the direction of the depth of the rotary basket (drum) to a substantially large extent, and which is improved in drying efficiency.

To this end, a dryer includes a rotary basket for accommodating an object to be dried, with the basket having a shape of a hollow cylinder closed at one end thereof and opened at the other end thereof, and with the object to be dried being placed into or taken out of the basket through the opening of the basket. The basket includes a multiplicity of vent holes formed in a peripheral portion thereof, with means for driving the rotary basket. A blower means blows hot air into the rotary basket, with the hot air being introduced into the rotary basket through the opening while the axis of rotation of the rotary basket is adapted to be inclined so that the opening end of the rotary basket is located higher than the closed end thereof.

The object to be dried is rotated along the direction of rotation of the rotary basket and is simultaneously moved in the direction of the depth of the rotary basket. That is, as the rotary basket is rotated, the object to be dried is moved upwardly from a bottom portion of the rotary basket toward the opening thereof and then falls to return to the bottom side. Hot air flows into the rotary basket through the opening of the same, and flows out of the rotary basket through vent holes formed in a peripheral portion of the rotary basket. The hot air flows collide against the object to be dried while the object is moving toward the opening or falling, thereby effectively drying the object.

DESCRIPTION OF THE PREFERRED EMBODIMENT

Figure 1:
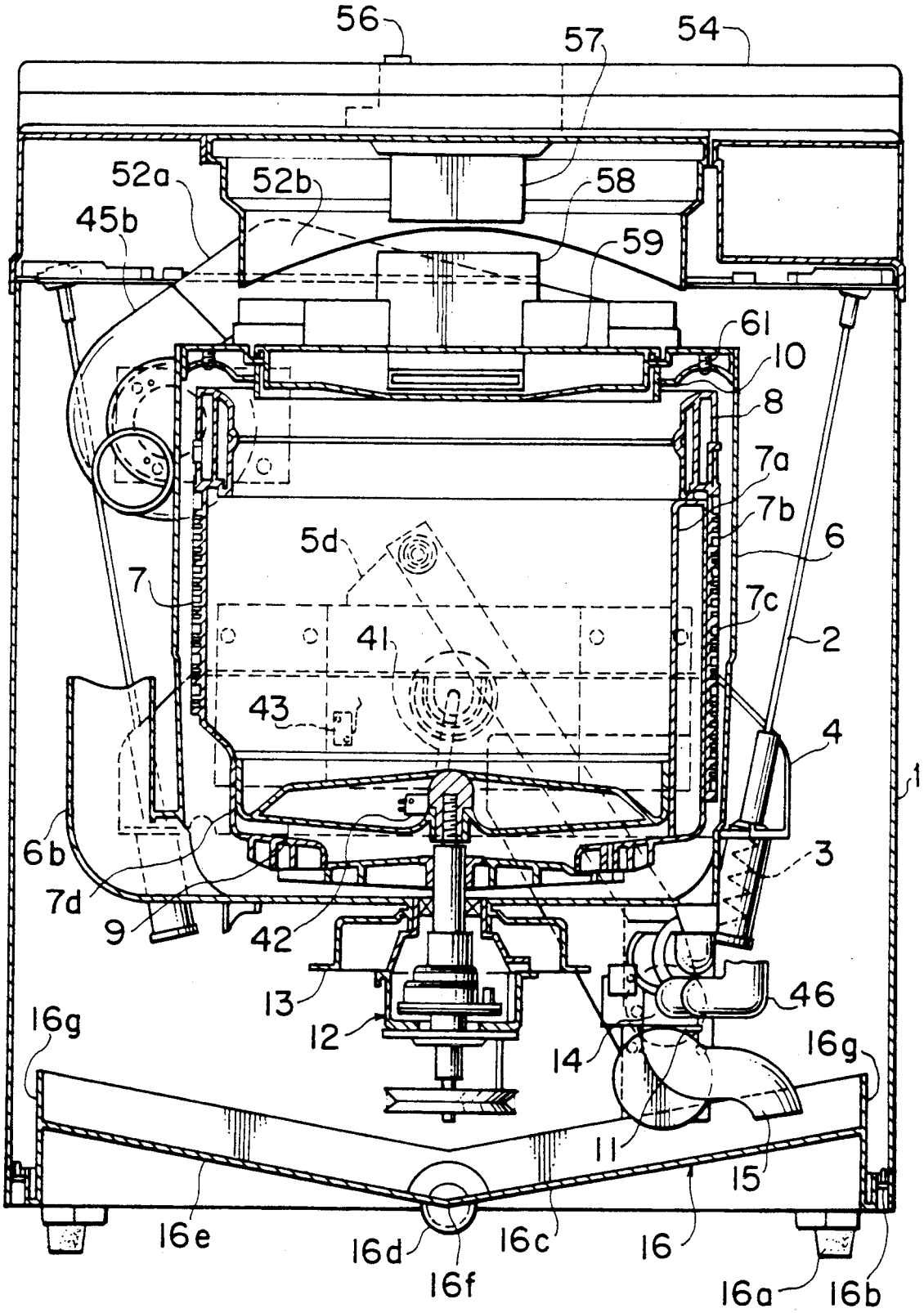
FIG. 1 is a longitudinal sectional front view of a washing/drying machine according to one embodiment of the present invention.

Referring to FIG. 1, a box-like steel frame 1 supports a tub 6 through suspension rods 2 and vibration isolation springs 3. A swing beam 5 is integrally fixed to the tub 6 through a swing base 4. Inside the tub 6 disposed is a rotary basket 7 having a cross-sectional configuration generally equal to that of the tub 6 and serving to effect washing, dehydrating and drying. A balance ring 8 is attached to an upper end portion of the basket 7 by friction welding or ordinary welding. An inner peripheral wall of the basket 7 is provided with a plurality of lifters *7a* in the form of longitudinal ribs for revolving clothes during drying. The lifters *7a* are equiangularly spaced from one another. A plurality of longitudinal grooves *7b* are formed between the lifters *7a* while equally spaced from one another. A plurality of dehydration holes *7c* are formed in the longitudinal grooves *7b*. A central bottom portion of the basket 7 is recessed to define a recess 7*d* in which a large-size pulsator 9 is rotatably fitted.

A basket cover 10 is fixed to an upper end portion of the tub 6 in order to prevent clothes from falling into the space between the tub 6 and the rotary basket 7.

A drainage device 11 and a drive unit 12 for rotating the pulsator 9 and the basket 7 are attached to an outer portion of the bottom of the tub 6 through a steel base 13. The base 13 has a generally box-like shape and is fixed to the outer portion of the bottom of the tub by means of screws or the like.

The drainage device 11 has a valve 14 connected to an inner portion of the bottom of the tub 6, and a drain hose 15 connected to the valve 14.

One end of the drain hose 15 is open, through which water is discharged to a base 16 disposed at a lower portion of the frame 1 when the valve 14 is opened.

The base 16 includes a plurality of feet 16*a*, supporting portions 16*b* for the frame 1, a water receiving portion 16*c*, and a drain outlet 16*d*.

The water receiving portion 16*c* has a central portion 16*e* sloped toward a central portion 16*f* so that water discharged from the drain hose 15 can smoothly flow to the central portion 16*f* and can be smoothly discharged through the drain outlet 16*d* provided at the central portion 16*f*. Water discharged through the drain outlet 16*d* flows to the outside through a hose or the like (not shown) to be attached to the drain outlet 16*d*.

The water receiving portion 16*c* also has a rib 16*g* which is provided at the outer periphery thereof to prevent water from overflowing the water receiving portion 16*c*.

Figure 2:
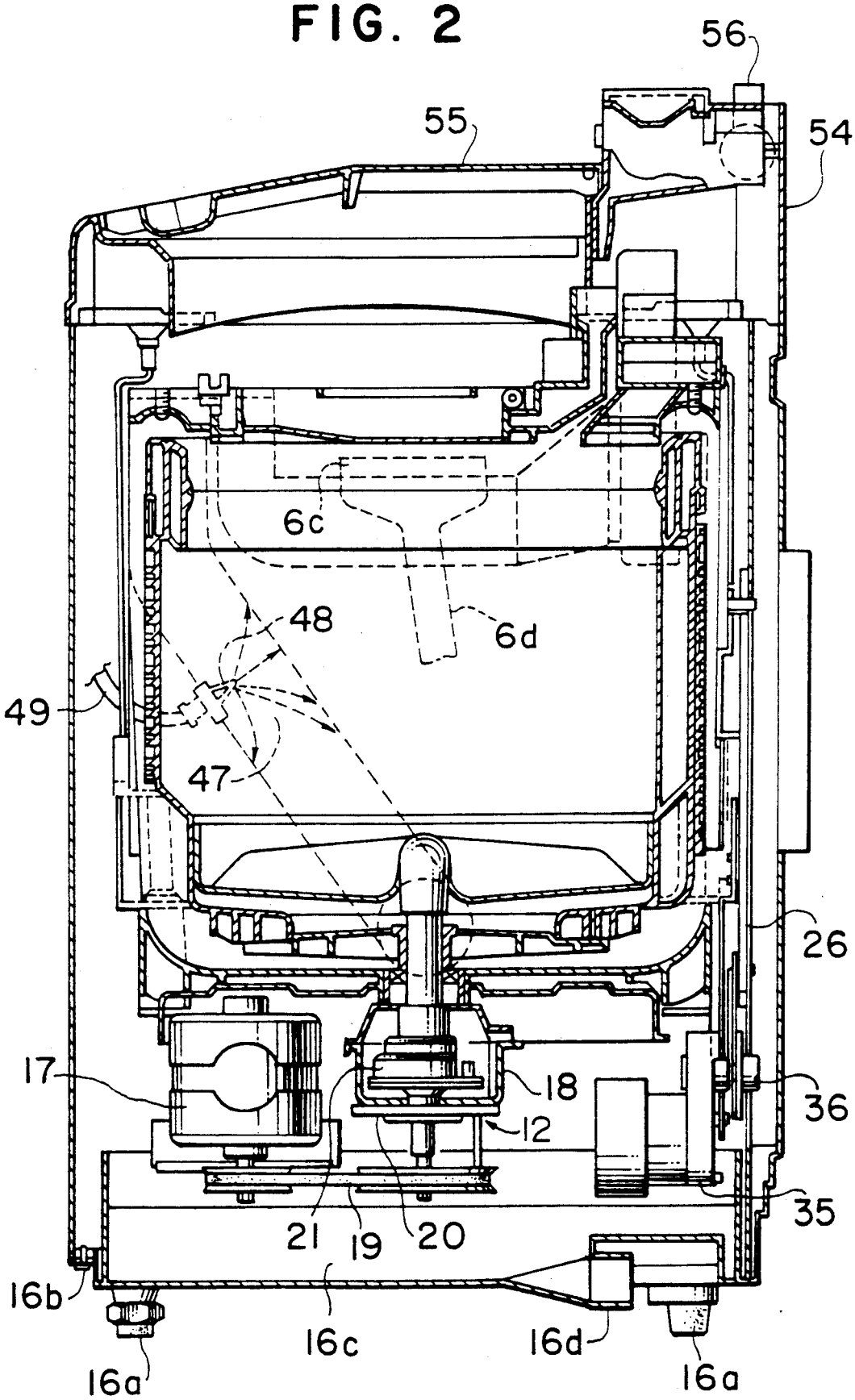
FIG. 2 is a longitudinal sectional side view of the machine.

The drive unit 12 has, as illustrated in FIG. 2, a motor 17, a clutch mechanism 18, a transmission mechanism 19 for transmitting the torque of the motor 17 to the clutch mechanism 18, a brake device 20 for stopping the rotation of the basket 7, and a reduction mechanism 21 for transmitting the torque of the motor 17 to the pulsator 9 while reducing the speed.

The motor 17 and the clutch mechanism 18 are disposed in front and in rear relative to each other, as viewed from a front of the machine.

Figure 3:
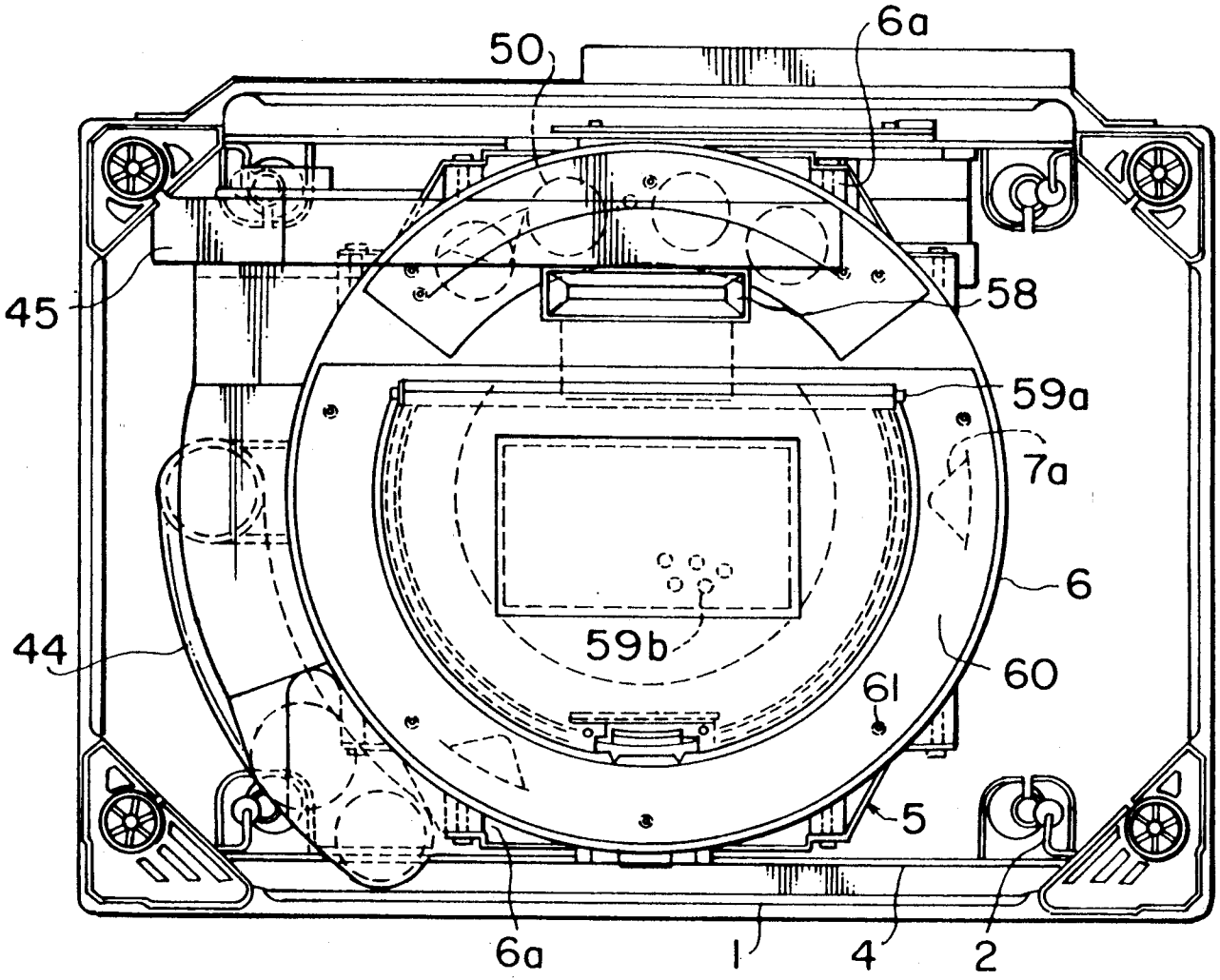
FIG. 3 is a plan view of the machine when the top cover is removed.
Figure 4:
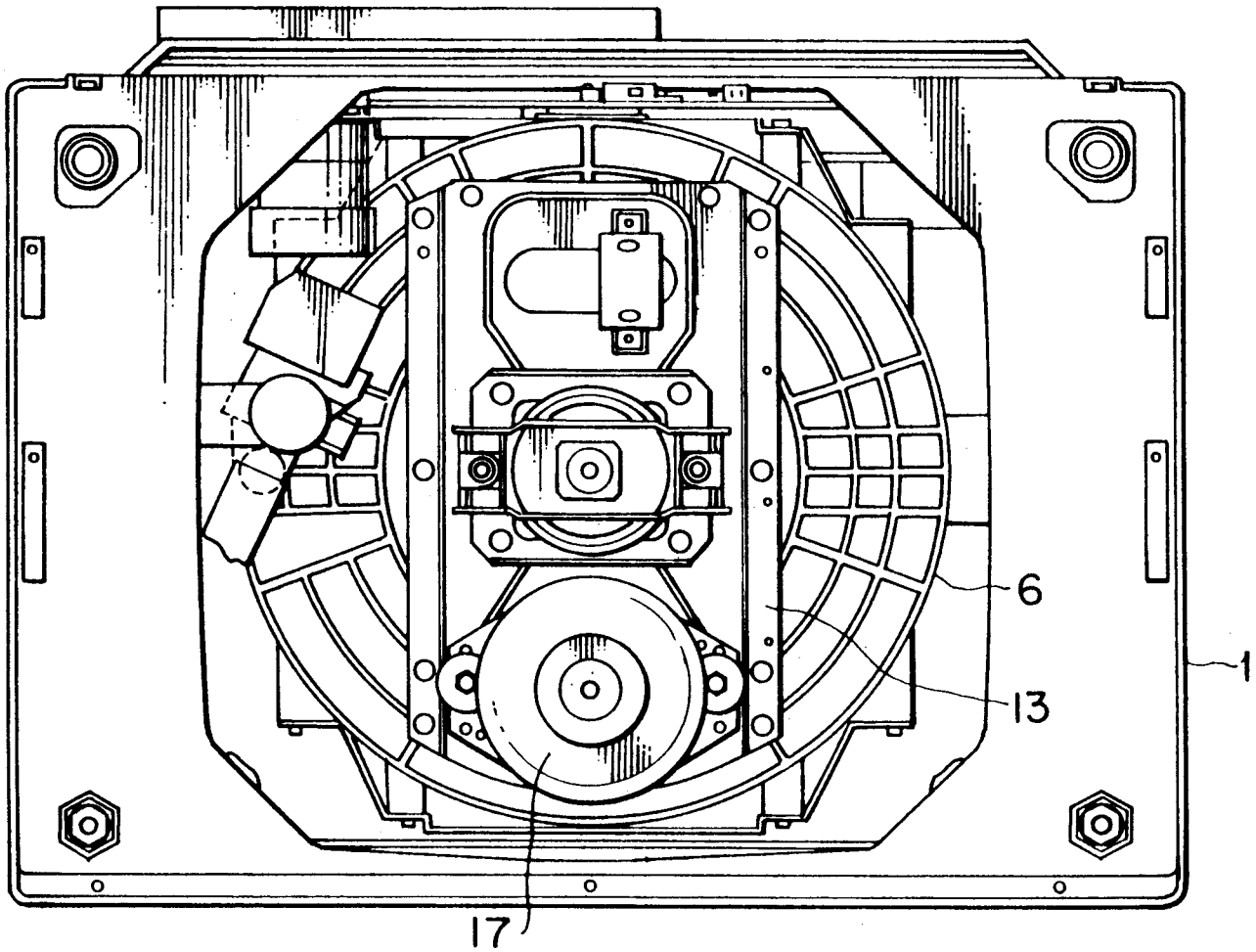
FIG. 4 is a bottom view of the machine.

A plurality of attachment bosses 6*a* are provided on each of two front and rear outer circumference portions of the tub 6, through which the swing beam 5 is fixed to the tub 6, as shown in FIG. 3.

Figure 5:
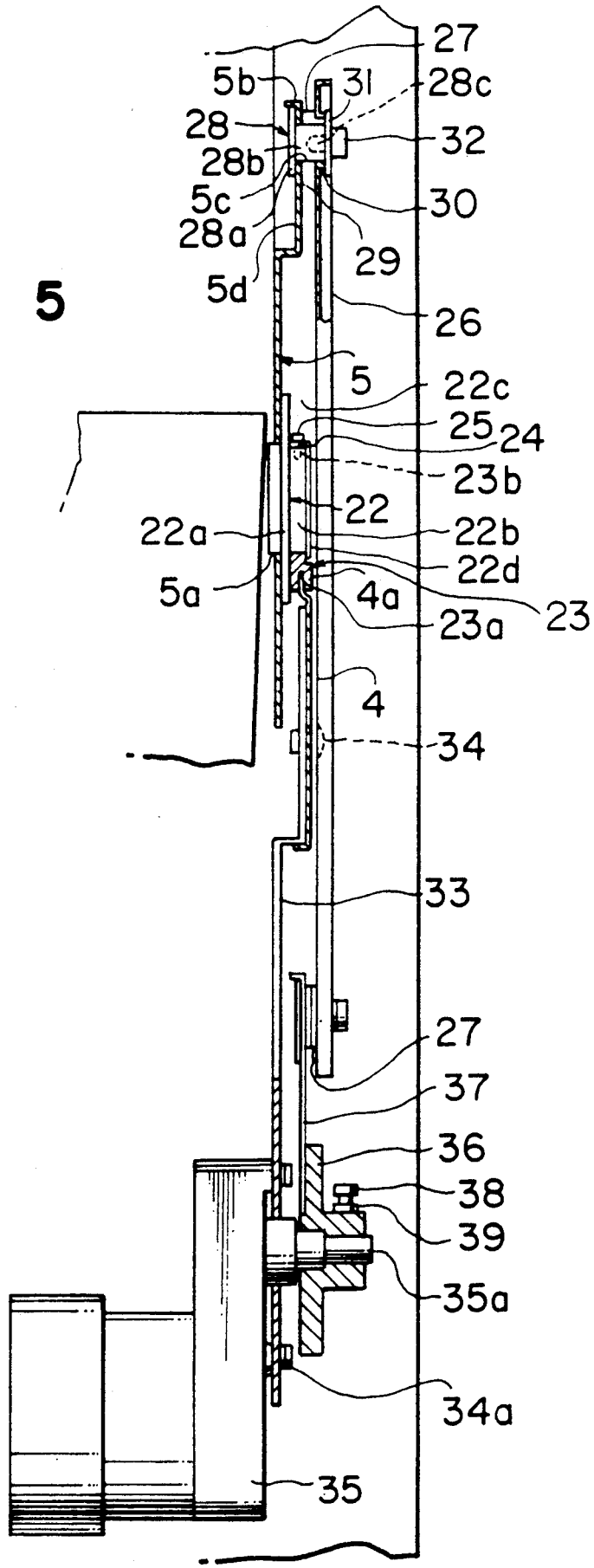
FIG. 5 is an enlarged sectional view of a link mechanism.

As shown in FIG. 5, a semicircular recess 5*a* is formed in a central portion of the swing beam 5, and a stepped shaft 22 is fitted in the recess 5*a* and is fixed by, for example, welding. The stepped shaft 22 has a stopper portion 22*a*, a shaft portion 22*b*, a stationary ring 22*c*, and a fitting portion 22*d*.

A U-shaped bearing 23 is fitted to the shaft portion 22*b* of the stepped shaft 22. The bearing 23 has a groove 23*a* formed in its outer peripheral portion, and two screw holes 23*b* formed in its extreme end portions corresponding to the two ends of the U-shape.

A U-shaped recess 4*a* formed in a central portion of the swing base 4 is fitted to the groove 23*a*, and a plate spring 24, formed of an elastic material, is fixed to the top of the bearing 23 by fastening with screws 25.

The bearing mechanisms thus constructed are respectively provided at two positions in the front and rear sides of the tub 6.

A crank 26 has opposite ends to which metallic members 27 are press-fitted. A crank shaft 28 is rotatably fitted in the metallic member 27.

The crank shaft 28 has a fixing flange 28*a* provided at its one and, a shaft portion 28*b* provided at its center, and a screw hole 28*c* formed at its other end.

The crank shaft 28 is inserted in a projecting portion 5*d*, formed integrally with the corresponding swing beam 5, has a bent portion 5*b* and a hole 5*c*, and the fixing flange 28*a* is fixed by welding to the projecting portion 5*d*.

The crank 26 is rotatably retained on the shaft portion 28*b* of the thus-fixed crank shaft 28 together with a thrust ring 29, the metallic member 27, a thrust ring 30 and a washer 31 by fastening with a screw 32.

A motor base 33 is fixed to the swing base 4 by a screw 34, and a swing motor 35 is fixed to a lower end portion of the motor base 33 by a screw 34*a*.

The swing motor 35 has an output shaft 35*a*. A boss 36 and an arm 37, which are integrated together, are fixed to the output shaft 35*a* by a screw 38 and a rock nut 39.

The arm 37 has a portion interconnected to the boss 36, and a crank portion, with an unillustrated bent portion and an unillustrated hole like those of the projecting portion 5*d* of the swing beam 5.

A switch lever 41 is fixed to the stepped shaft 22 by screws or the like so as to engage with microswitches 42 and 43 fixed to the swing base 4.

Figure 6:
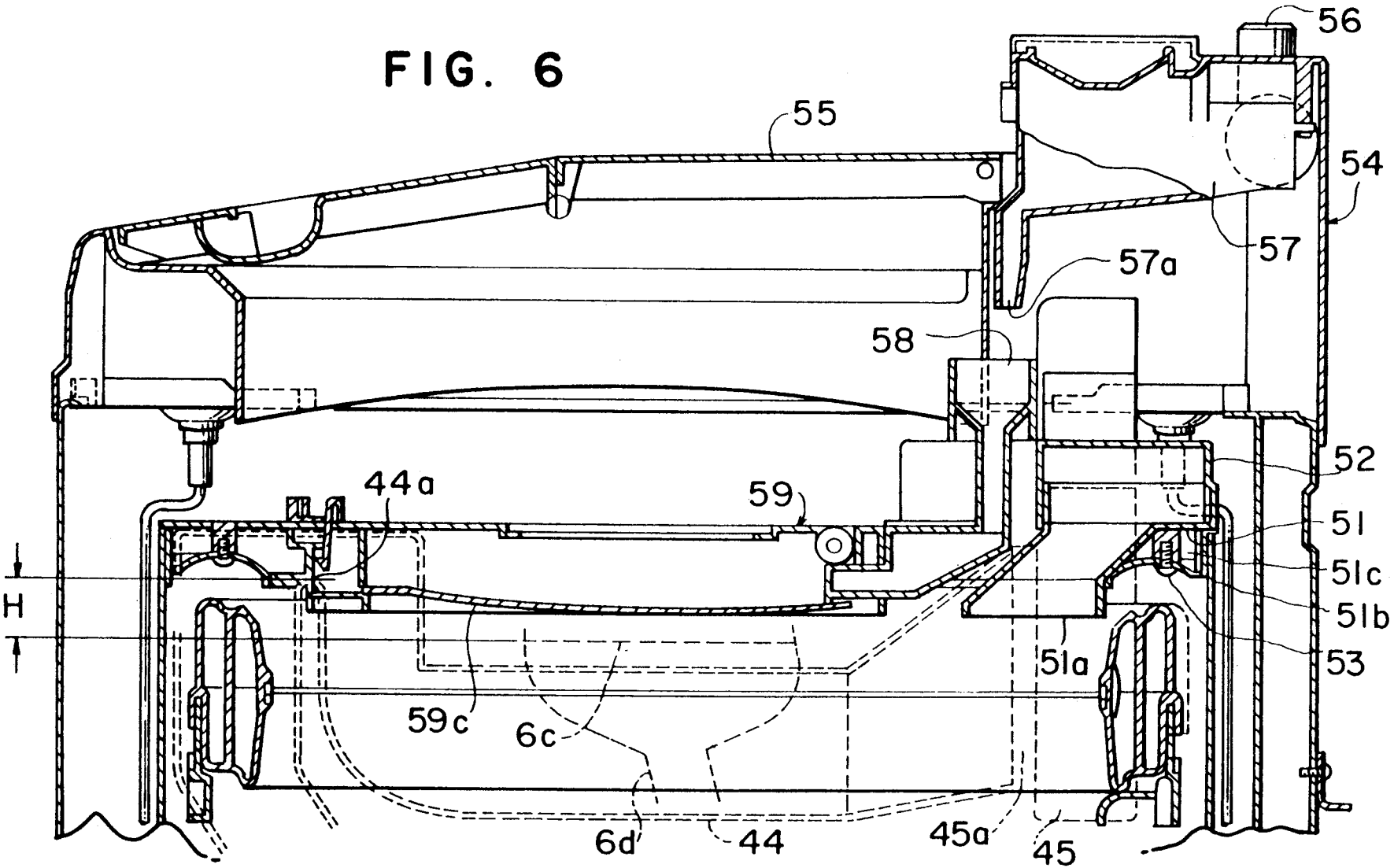
FIG. 6 is an enlarged sectional view of a top section of the machine.

A duct 44 for hot air flow circulation during drying operation has, as shown in FIG. 6, one end connected to an exhaust opening 6*b* formed in a lower end portion of the tub 6 in an air tight manner, while the other end is connected to a drawing opening 45*a* of a blower 45 in a similar manner.

A central inside diameter portion 44*a* of the duct 44 is located higher, by a distance or height H, than the upper end of an overflow preventing opening 6*c* formed integrally with the tub 6, thereby preventing washing water from reversely flowing to electrical sections including the motor for driving the blower 45.

A hose 6*d* connected to the overflow preventing opening 6*c* is connected to a hose 46 of the drainage device 11, thereby enabling overflow water to be discharged via the drain hose 15.

As shown in FIG. 2, a nozzle 48 is provided on a portion of the duct 44 between the connection to the exhaust opening 6*b* and the central inside diametral portion 44*a* to jet water 47 into the duct so as to form curtain-like water flow.

A water supply hose 49 is connected to an external water supply source through a water supply valve and so on.

PTC heaters 50 (FIG. 6) are air-tightly enclosed by a base 51 and a case 52 for supplying hot air during drying.

The case 52 is provided with an opening 52*a* to be connected to an outlet 45*b* of the blower 45, and also with a hot air flow space 52*b* over the PTC heaters 50.

The base 51 has an outlet 51*a* formed in its central portion for supply of hot air to the basket 7, with an outer peripheral wall 51*b* being abutted against an inner peripheral wall of the basket cover 10, and a plurality of bosses 51*c* formed at its bottom. The base 51 is fixed at the bosses 51*c* to the basket cover 10 with screws 53.

A top cover assembly 54 includes a lid 55 disposed at the center, and a water supply valve 56 and a softener dispenser 57, both disposed at the rear of the lid 55.

A water supply hole 57*a* is formed in a lower portion of the softener dispenser 57. Water introduced through the water supply valve 56 is supplied through the water supply hole 57*a* into a water receiver 58 provided on the base 51.

The water receiver 58 is generally L-shaped and serves to supply water into an inner lid assembly 59.

The inner lid assembly 59 has a pivot 59*a* on which the lid is pivoted to be opened or closed, a reverse lid member 59*c* having a plurality of drain holes 59*b*, and a handle portion 59*d*. The inner lid assembly 59 is fitted in a base 60 in a water-tight manner.

A base 60 is fixed to the basket cover 10 with screws 61.

The circuit generally includes an input circuit group, an output circuit group, a load circuit group (including actuators), and other circuits.

The input circuit group includes a safety switch 62 which is turned on or off by the opening/closing of the lid 55 or by a certain amplitude of vibration of the tub 6 due to the unbalance of clothes during high speed rotation of the basket for dehydration, a water level sensing circuit 63 for detecting the level of water supplied in the tub 6 at the washing operation, a Hz signal circuit 65 which supplies a 50/60 Hz signal to a microcomputer 64, an input switch read circuit 66, a door switch read circuit 67, a current sensing circuit 68, a cloth amount sensing circuit 69, a temperature sensor 70, a humidity sensor 71 and a humidity sensing circuit 72.

The output circuit group includes a six-phase clock circuit 73 for amplifying signals from the microcomputer 64, a procedure/clock display circuit 74, a drive circuit 75 having amplifier circuits and switching circuits for driving a plurality of load devices, a buzzer 76 and an oscillation circuit 77.

The load circuit group includes a washing motor 17, water supply valves 78 and 79, a detergent injection Mg 80, a softener Mg 81, a valve state detection switch 83 linked to a drainage motor 82, a swing motor 35 for swinging the tub 6 after the completion of a washing process consisting of washing, rinsing and dehydrating steps, a motor lock Mg 85 for locking the swing motor 35 to maintain in a inclined state, a position sensor 86 for detecting the swing position of the tub 6 with the microswitches 42 and 43, a clutch Mg 87, a dryer motor 88, and a first heater 89 and a second heater 90 consisting of PTC heaters 50.

There are other circuits including a clock generator circuit 91 for producing a fundamental clock for the microcomputer 64, a reset circuit 93 for initializing the microcomputer 64 when a power switch 92 is turned on, and a runaway detection circuit 95 for actuating an auto-off switch 94 to automatically turn off the power switch 92 if runway of the microcomputer 64 takes place. The auto-off switch 94 also has a function of turning off the power switch 92 a certain period of time after the completion of the overall operation.

An auto-on relay 96 has a function of turning on a certain period of time after being set, and which is used for reserved operation, i.e., an operation cycle in which the machine is started after a certain period of time.

A power supply circuit 97 is provided to supply each component with power.

Figure 10:
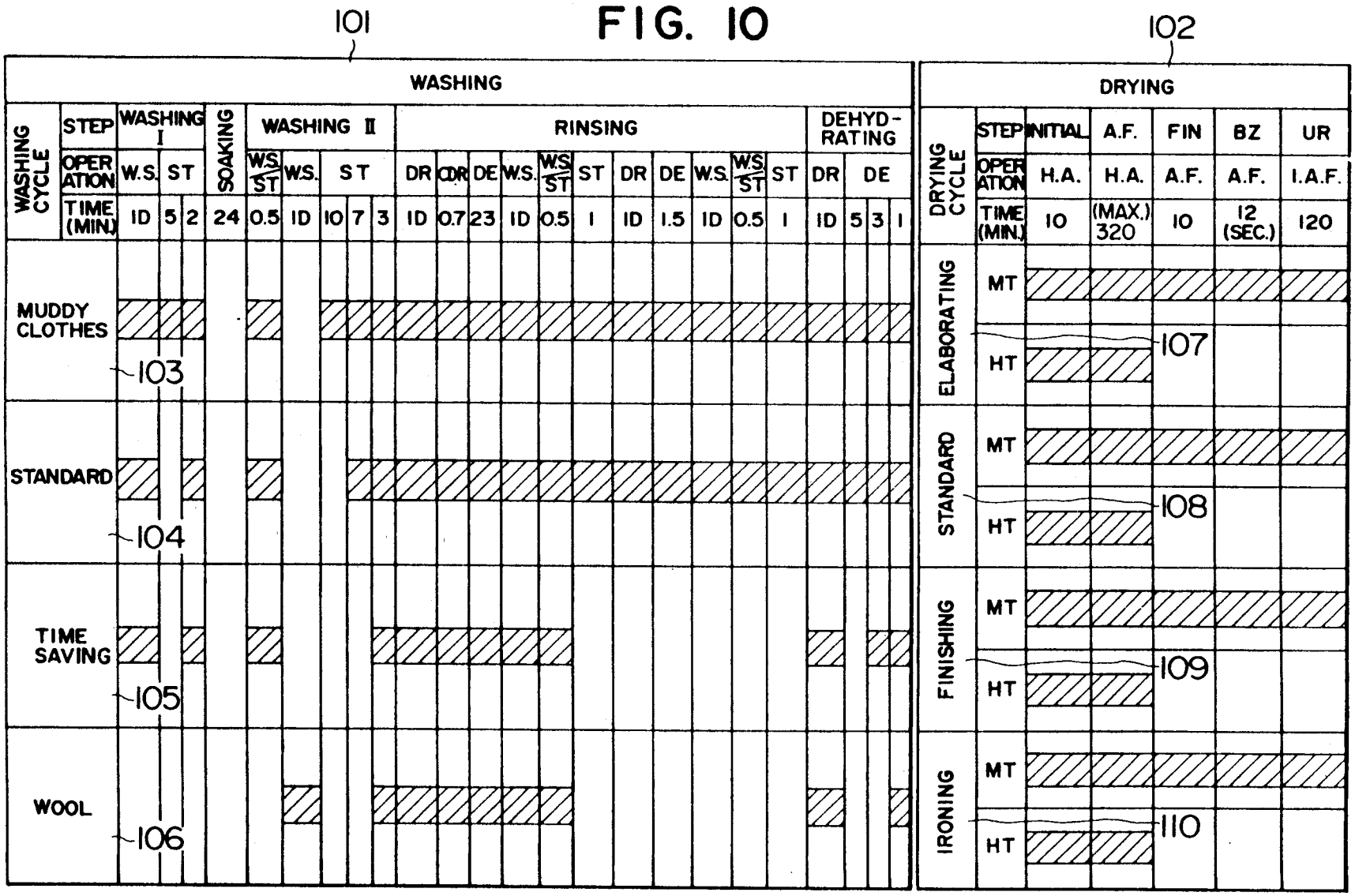
FIG. 10 is a time-chart of operation cycles of the washing/drying machine.

The above-described circuits are provided on a membrane board 98 having a display/operation panel and a main board 99 having electrical processing sections, and a loads/actuator portion 100 is connected to these boards. A as shown in FIG. 10, there are two operation processes: a washing process 101 and a drying process 102. The operation cycles are generally classified into one-process washing-drying cycles (fully-automatic cycles) and manual cycles.

In each of the one-process washing-drying cycles (hereinafter referred to simply as washing-drying cycles), washing steps and drying steps are automatically effected successively as one continuous process. Each washing-drying cycle consists of the washing steps including muddy clothes washing cycle 103, standard washing cycle 104, time saving washing cycle 105 or wool washing cycle 106, and of the drying steps including elaborating drying cycle 107, standard drying cycle 108, finishing drying cycle 109 or ironing drying cycle 110. Operating times in each cycle are as indicated by the hatched areas in FIG. 10.

Figure 11:
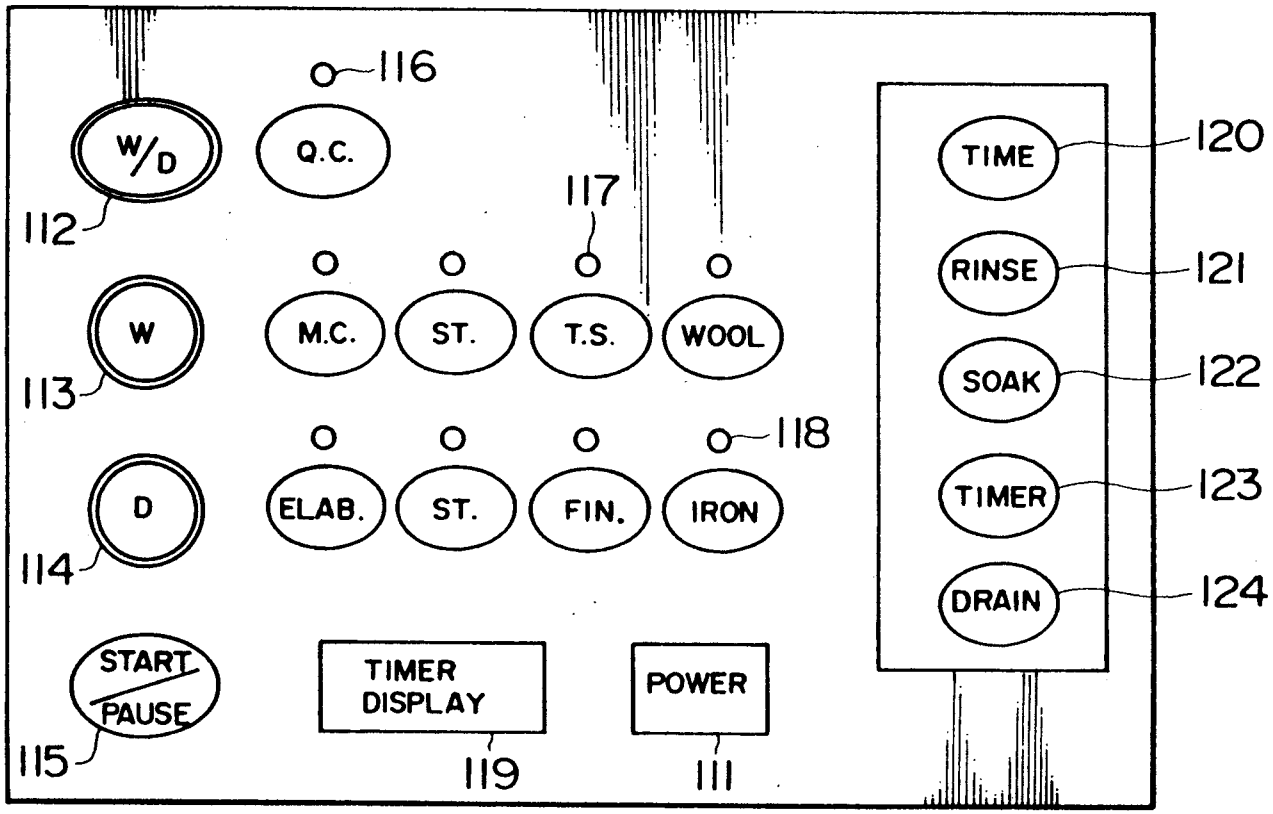
FIG. 11 shows an operation panel.

As shown in FIG. 11, the operation panel surface includes a power supply button 111, a washing-drying button 112, a washing button 113, a drying button 114, a start/pause button 115, a cloth amount checking LED 116, four washing cycle LEDs 117, four drying cycle LEDs 118, and a remaining time/reservation timer display 119. In a cover (not shown) there are provided a time setting button 120, a rinsing button 121, a soaking button 122, a reservation timer button and a drainage button 124.

Figure 8:
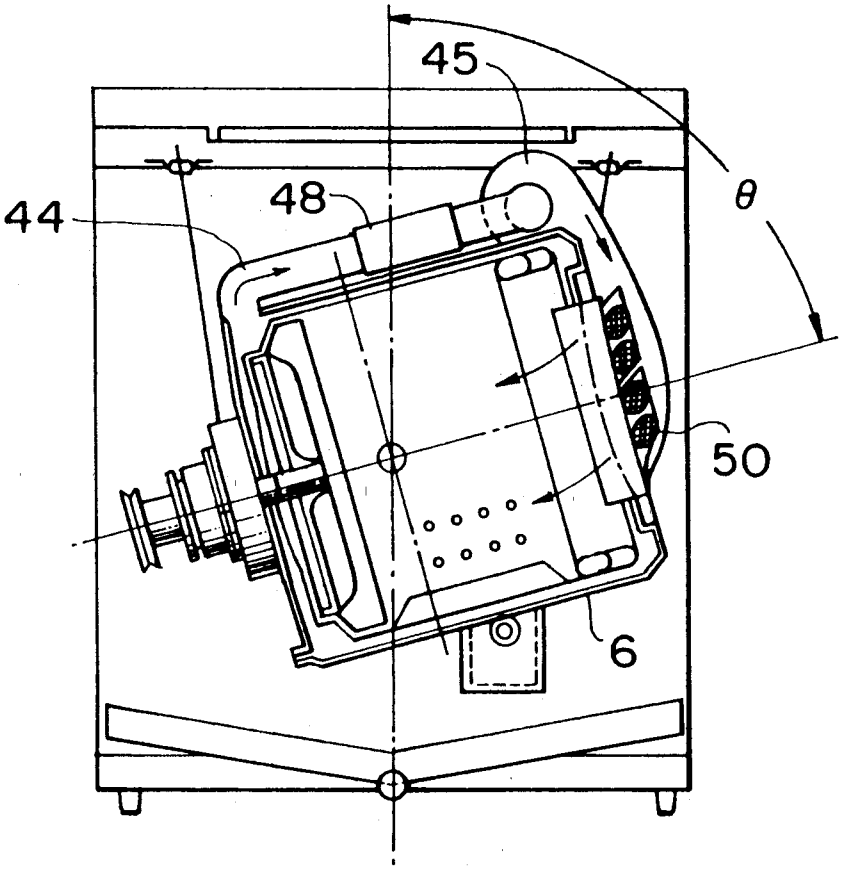
FIG. 8 shows the machine during drying operation.
Figure 7:
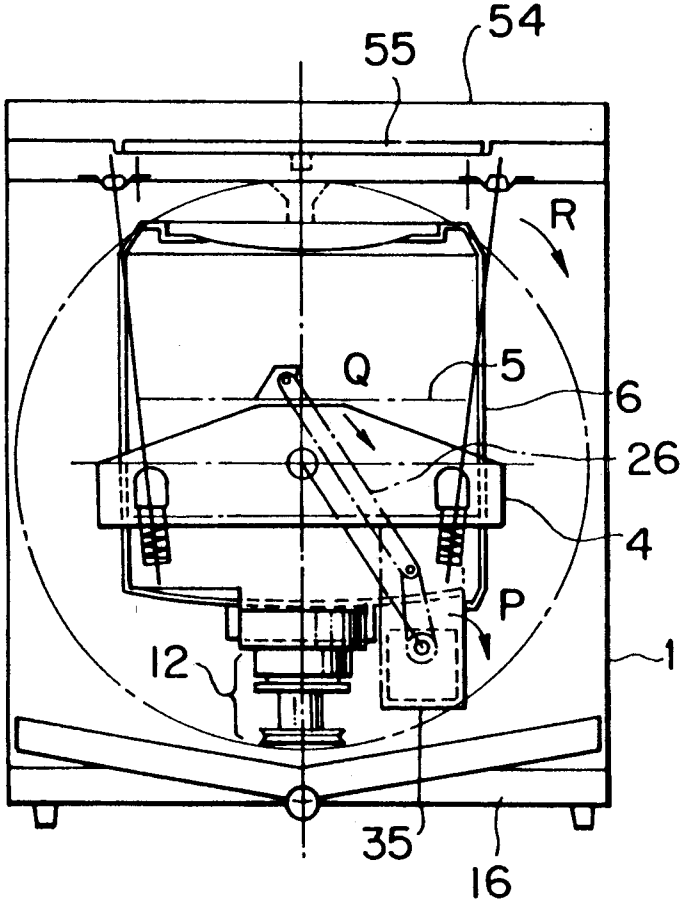
FIG. 7 shows the machine during washing/dehydrating operation.
Figure 9:
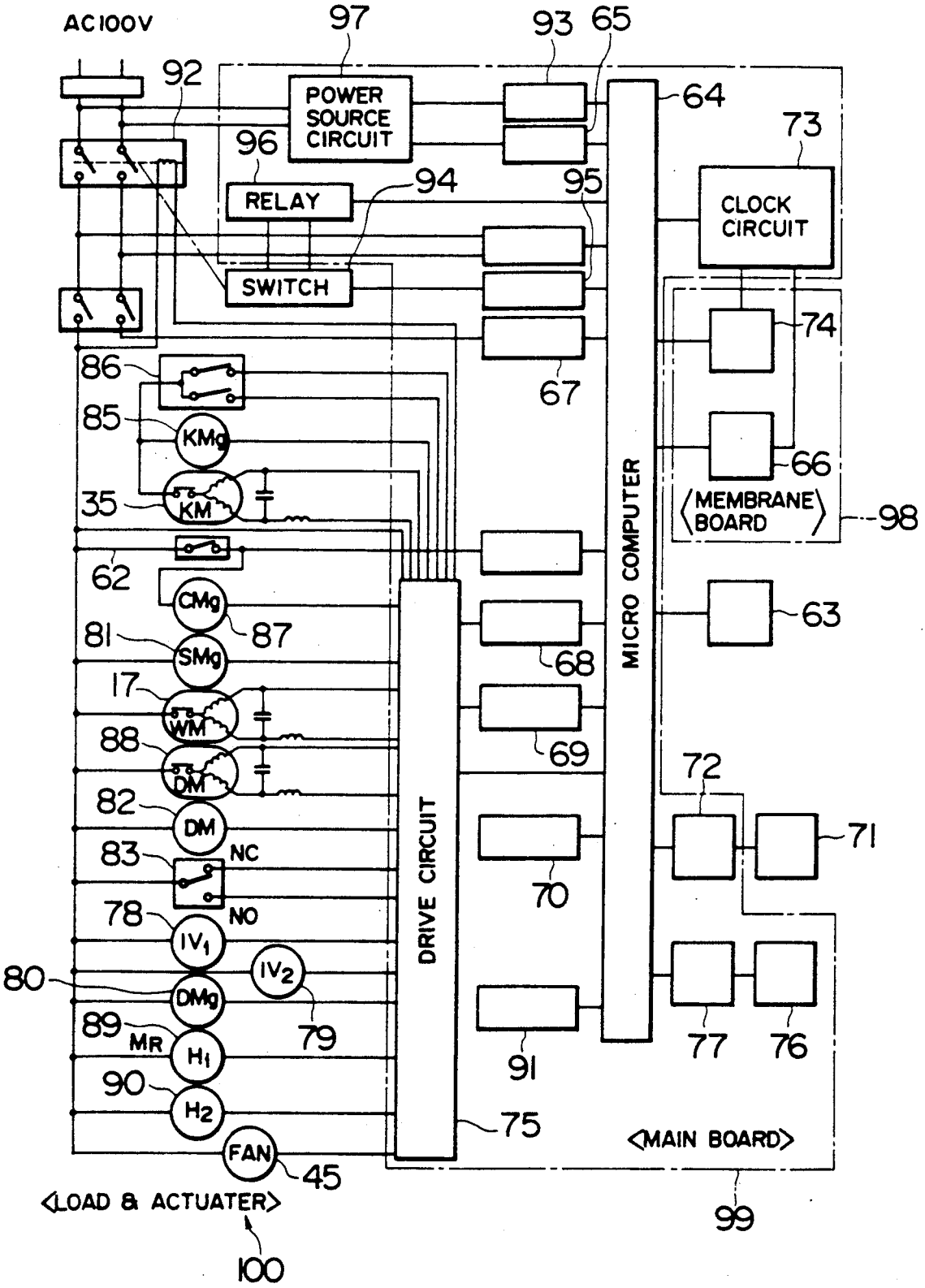
FIG. 9 is a circuit diagram of the washing/drying machine.

Basically, the machine is operated in such a manner that, in each washing-drying cycle, the washing process 101 for washing, rinsing and dehydrating is conducted while the tub 6 is held in a vertical position, i.e., in the state shown in FIG. 7, and thereafter the tub 6 is then swung and inclined by an angle $\theta$ to conduct the drying process 102 as shown in FIG. 8. After the drying process, the tub 6 is returned back to the state shown in FIG. 7, thereby completing one washing-drying cycle.

First, the lid 55 and the inner lid assembly 59 are opened, and clothes are placed into the basket 7. The inner lid assembly 59 and the lid 55 are thereafter closed respectively.

When the washing-drying button 112 of the operation panel is pressed and the start button 115 is thereafter pressed, the operation in accordance with the washing-drying cycle consisting of the standard washing cycle 104 and the standard drying cycle 108 is thereby started. The washing process 101 and the drying process 102 are conducted to effect this washing-drying cycle. Thereafter, the clothes washed and dried can be taken out from the machine.

During the washing-rising-dehydrating process of this cycle, the tub 6 is maintained in the vertical position. Immediately before the drying process 102 is started, the swing motor 35 is energized to swing the tub 6 by the angle $\theta$ through the link mechanism. That is, as the swing motor 35 operates, the arm 37 integrally connected to the output shaft 35*a* (FIG. 5) is swung in the direction P of FIG. 7 to pull the crank 26 in the direction Q. Therefore, the tub 6 is pivoted in the direction R on the stepped shaft 22 fixed to the swing beam 5. The swing motor 35 is stopped according to the commands from the position sensor 86, and the swing motor 35 is locked by the motor lock Mg 85. The drying process 102 is conducted in this state.

During the drying process 102, the basket 7 is rotated at a low speed by the drying motor 88. Since the basket 7 is inclined at the angle $\theta$ of about 75° (FIG. 8), the clothes in the basket 7 are moved upward in the rotational direction, and naturally fall when brought close to the uppermost portion of the basket 7. At this time, the clothes fall to an inner position relative to the position from which they are first moved upwardly. The clothes can therefore be mixed suitably, that is, their positions are always changed with each other, so that the clothes are uniformly blown with the hot air, thereby enabling the clothes to be uniformly dried. In other words, the drying efficiency is improved.

The operation based on each of the other washing-drying cycles is performed as described below. For example, in a case where the washing cycle different from the standard washing cycle 104 is selected, the washing-drying button 112 is first pressed, and the washing button 113 is subsequently pressed to select the desired washing cycle. The start button 115 is thereafter pressed to start the operation in accordance with the washing-drying cycle consisting of the desired washing cycle and the standard drying cycle 108.

In a case where only the drying cycle is changed or in a case where both the washing cycle and the drying cycle are changed, the operation is conducted by the same procedure to execute the desired washing-drying cycle.

To select each of single cycles, e.g., one washing cycle alone or one drying cycle alone, the corresponding button is pressed before the start button 115 is pressed. It is thereby possible to perform the operation in accordance with the desired cycle.

What is claimed is:

1. A dryer comprising:

a rotary basket for accommodating an object to be dried, said basket having a shape of a hollow cylinder closed at one end thereof and opened at the other end thereof through which said object to be dried is thrown into or taken out from said rotary basket;

a plurality of vent holes provided on a peripheral wall of said rotary basket;

means for rotating said rotary basket;

means for swinging said rotary basket, thereby inclining an axis of rotation thereof to locate said opening end thereof slightly higher than said closed end thereof;

an air flow passage provided on the outer peripheral side of said rotary basket, said air flow passage communicating at one end thereof with a closed end portion of said rotary basket and at the other end thereof with an opening end portion of said rotary basket;

blower means provided in said air flow passage, thereby air form said blower means flows into said rotary basket through said opening end portion thereof and flows out from said rotary basket through said closed end portion thereof into said air flow passage; and heater means provided in said air flow passage on a downstream side of said blower means for heating air from said blower means.

2. A dryer according to claim 1, wherein said dryer further comprises dehumidifying means provided in said air flow passage on an upstream side of said blower means.

3. A dryer according to claim 2, wherein said dehumidifying means uses cooling water.

4. A dryer according to claim 2, wherein said dehumidifying means injects cooling water into said air flow passage.

5. A dryer according to claim 4, wherein said dehumidifying means includes a water jetting nozzle facing an interior of said air flow passage.

6. A dryer according to claim 1, wherein said air flow passage extends above said rotary basket.

7. A dryer according to any one of claims 1 to 6, wherein an angle at which said rotary basket is inclined is about 15 degrees from the horizontal.

8. A dryer according to any one of claims 1 to 6, wherein said rotary basket is so inclined that as said rotary basket is rotated, said object to be dried is upwardly moved from said closed end portion thereof towards said opening end portion thereof and falls to return to said closed end portion of said rotary basket.

9. A dryer according to one of claims 1 to 6, wherein said at least one lifter is provided on an inner peripheral surface of said basket along an axis of rotation of said rotary basket.

10. A washing/drying machine comprising:

a rotary basket for accommodating an object to be washed and dried, said basket having a shape of a hollow cylinder having a closed end and an open end opposite said closed end through which said object is placed into or taken out from said rotary basket;

a tub incorporating said rotary basket therein, said tub being capable of storing water therein;

a frame incorporating said tub therein;

a plurality of holes provided on a peripheral wall of said rotary basket;

an impeller provided within said rotary basket adjacent to said closed end thereof, said impeller having an outer diameter close to an inner diameter of said rotary basket;

means disposed outside of said tub adjacent to a bottom thereof for rotating said impeller and said rotary basket;

means provided on the frame for swinging said tub so as to retain an axis of rotation of said rotary basket in a vertical position during a washing or dehydrating operation and a tilting of said tub so as to incline said axis of rotation of said rotary basket to locate said open end thereof slightly higher than said closed end thereof;

a base disposed within said frame, said tub being supported on said base so as to be swingably supported relative thereto; and suspension means for suspending said base within said frame, said suspension means including vibration isolation means for supporting said base within said frame in a manner so as to isolate vibrations of the rotary basket with respect to the frame.

11. A washing/drying machine according to claim 10, wherein said suspension means further includes four suspension rods.

12. A washing/drying machine according to claim 10, wherein said tub is swung on said frame by means of swing motor means.

13. A washing/drying machine according to claim 12, wherein a torque from said swing motor means is transmitted to said tub through a crank mechanism.

14. Washing/drying machine comprising:

a rotary basket for accommodating an object to be washed and dried, said basket having a shape of a hollow cylinder having a closed end and an open end opposite the closed end through which said object is placed into or taken out from said rotary basket;

a tub incorporating said rotary basket therein, said tub being capable of storing water therein;

a frame incorporating said tub therein;

a plurality of holes provided on a peripheral wall of said rotary basket;

an impeller provided within said rotary basket adjacent to said closed end, said impeller having an outer diameter close to an inner diameter of said rotary basket;

means disposed outside of said tub adjacent to a bottom thereof for rotating said impeller and said rotary basket;

means for swinging said tub so as to retain an axis of rotation of said rotary basket in a vertical position during a washing or dehydrating operation and a tilting of said tub so as to incline said axis of rotation of said rotary basket to locate said open end slightly higher than said closed end;

a base disposed within said frame on which said tub is swingably supported; and suspension means for suspending said base within said frame, wherein said tub is swung on said frame by swing motor means, and wherein said swing motor means is supported on said base.

15. A washing/drying machine comprising:

a rotary basket for accommodating an object to be washed and dried, said basket having a shape of a hollow cylinder having a closed end and an open end opposite the closed end through which said object is placed into or taken out from said rotary basket;

a tub incorporating said rotary basket therein, said tub being capable of storing water therein;

a frame incorporating each tub therein;

a plurality of holes provided on a peripheral wall of said rotary basket an impeller provided within said rotary basket adjacent to said closed end, said impeller having an outer diameter close to an inner diameter of said rotary basket;

means disposed outside of said tub adjacent to a bottom thereof for rotating said impeller and said rotary basket;

means for swinging said tub so as to retain an axis of rotation of said rotary basket in a vertical position during a washing or dehydrating operation and a tilting of said tub so as to incline said axis of rotation of said rotary basket to locate said open end thereof slightly higher than said closed end; and an air passage disposed outside of said tub, one end of said air passage is communicated with an interior of said tub through a bottom of the tub, and the other end of said air passage is communicated with said open end of said rotary basket.

16. A washing/drying machine according to claim 15, further comprising an air circulating passage including a passage portion extending from said open end of said rotary basket to a bottom of said tub through an interior of said rotary basket, and a passage portion extending from said bottom of said tube from said open end of said rotary basket through said air passage.

17. A washing/drying machine according to claim 16, further comprising a blower provided in said air passage.

18. A washing/drying machine according to claim 17, further comprising a heater provided in said air passage on a downstream side of said blower for heating air flowing from said air passage.

19. A washing/drying machine according to claim 18, wherein said heater uses a PTC element.

20. A washing/drying machine according to claim 18, wherein said heater is disposed adjacent to said open end of said rotary basket.

21. A washing/drying machine according to claim 20, wherein said blower is disposed above said rotary basket.

22. A washing/drying machine according to claim 15, wherein said air passage is provided on a portion of an outer periphery of said tub which is to be located in an upper position when said tub is swung.

23. A washing/drying machine according to claim 15, wherein said machine further comprises dehumidifying means provided in said air passage.

24. A washing/drying machine according to claim 15, wherein at least one lifter is provided on an inner peripheral surface of said rotary basket along an axis of rotation of said rotary basket.

25. A washing/drying machine according to claim 15, wherein an angle at which said rotary basket is inclined is between 5 degrees and 20 degrees from the horizontal.

26. A washing/drying machine according to claim 25, wherein the angle at which said rotary basket is inclined is about 15 degrees from the horizontal.

27. A washing/drying machine according to claim 15, wherein said rotary basket is so inclined that as said rotary basket is rotated, said object is upwardly moved from said closed end toward said open end thereof and falls to return to said closed end of said rotary basket.

28. A washing/drying machine according to claim 14, wherein a torque from said swing motor is transmitted to said tub through a crank mechanism.

29. A washing/drying machine according to claim 15, further comprising a base disposed within said frame on which said tub is swingably supported, and suspension means for suspending said base within said frame.

30. A washing/drying machine according to claim 29, wherein said base is suspended by suspension means through vibration isolation springs.

31. A washing/drying machine according to claim 29, wherein said suspension means includes four suspension rods.

32. A washing/drying machine according to claim 29, wherein said tub is swung on said frame by means of swing motor means.

33. A washing/drying machine according to claim 32, wherein a torque from said swing motor means is transmitted to said tub through a crank mechanism.

34. A washing/drying machine according to claim 33, wherein said swing motor means is supported on said base.

35. A washing/drying machine according to one of claims 29 to 34, further comprising an air circulation passage including a passage portion extending from said open end portion of said rotary basket to a bottom of said tub through an interior of said rotary basket, and a passage portion extending from said bottom of said tub from said open end of said rotary basket through said air passage.

36. A washing/drying machine according to one of claims 29 to 34, further comprising a blower provided in said air passage.

37. A washing/drying machine according to claim 36, further comprising a heater provided in said air passage on a downstream side of said blower for heating air flowing in said air passage.

38. A washing/drying machine according to claim 37, wherein said heater uses a PTC element.

39. A washing/drying machine according to claim 37, wherein said heater is disposed adjacent said open end of said rotary basket.

40. A washing/drying machine according to claim 39, wherein said blower is disposed above said rotary basket.

41. A washing/drying machine according to claim 35, wherein said air passage is provided on a portion of an outer periphery of said tub which is to be located in an upper position when said tub is swung.

42. A washing/drying machine according to claim 35, further comprising dehumidifying means provided in said air passage.

43. A washing/drying machine according to claim 35, wherein at least one lifter is provided on an inner peripheral surface of said rotary basket along an axis of rotation of said rotary basket.

44. A washing/drying machine according to claim 35, wherein an angle at which said rotary basket is inclined is between 5° and 20° from the horizontal.

45. A washing/drying machine according to claim 44, wherein the angle at which said rotary basket is inclined is about 15° from the horizontal.

46. A washing/drying machine according to claim 35, wherein said rotary basket is so inclined that as said rotary basket is rotated, said object is upwardly moved from said closed end thereof toward said open end thereof and falls to return to said closed end of said rotary basket.

* * * * *